US005262033A

United States Patent [19]

Zega et al.

[11] Patent Number: 5,262,033

[45] Date of Patent: Nov. 16, 1993

[54] APPARATUS FOR THE CONTINUOUS ETCHINGS AND ALUMINUM PLATING OF STAINLESS STEEL STRIPS

[75] Inventors: Bogdan Zega, Geneva; Peter Boswell, Carouge, both of Switzerland

[73] Assignee: Nisshin Steel Co., Ltd., Tokyo, Japan

[21] Appl. No.: 842,763

[22] Filed: Mar. 2, 1992

Related U.S. Application Data

[60] Continuation of Ser. No. 648,240, Jan. 31, 1991, abandoned, which is a division of Ser. No. 522,039, May 11, 1990, abandoned.

[30] Foreign Application Priority Data

May 18, 1989 [EP] European Pat. Off. ..... 89810362.7

[51] Int. Cl.[5] ..... C23F 4/04

[52] U.S. Cl. ..... 204/298.37; 204/298.35; 204/129.35; 427/432; 118/419

[58] Field of Search ..... 204/298.37, 298.35, 204/129.35; 427/432; 118/419

[56] References Cited

U.S. PATENT DOCUMENTS 4,361,472 11/1982 Morrison, Jr. ..... 264/192.32
4,883,723 11/1989 Kilbane et al. ..... 427/432

FOREIGN PATENT DOCUMENTS 120474 6/1976 Fed. Rep. of Germany .
136047 6/1979 Fed. Rep. of Germany ..... 204/298.35

*Primary Examiner*—Donald R. Valentine
*Assistant Examiner*—Kishor Mayekar
*Attorney, Agent, or Firm*—Cushman, Darby & Cushman

[57] ABSTRACT

This method combines etching of the strip by passing through reduced pressure electric plasma discharge zones and the direct off-line dip-coating of the etched strip in a bath of molten aluminum.

The strip brought to cathode potential defilades continuously in registration with the magnet elements and anodes of a plurality of consecutively disposed magnetron devices and, therefore, directly into said molten metal bath.

3 Claims, 2 Drawing Sheets

1
1a
1b
1c
1d
2
3
4
5
6
7
8
9
10
11
12a
12b
12c
12d
12e
13a
13b
13c
13d
14a
14b
14c
14d
15
18
20
21
24
24a
24b
24c
24d
W
162
163
161
19
17
22
N
S

APPARATUS FOR THE CONTINUOUS ETCHINGS AND ALUMINUM PLATING OF STAINLESS STEEL STRIPS

This is a continuation of application Ser. No. 07/648,240, filed on Jan. 31, 1991 now abandoned, which is a divisional of Ser. No. 07/522,039 filed May 11, 1990 now abandoned.

INTRODUCTION

The present invention concerns a method and apparatus for plating stainless steel strips with aluminum in which, prior to plating, the strip is cleaned by passing into an electric gaseous discharge.

The continuous cleaning or etching of defilading elongated substrates such as wire, strips, bands and the like by ion bombardment prior to coating with another material or metal is known. This technique is indeed considered much more effective in the case of high chromium content alloys than the more conventional high temperature reductive cleaning treatments because chromium oxide is difficult to reduce and poor reduction efficiency is likely to cause problems of adhesion of the final aluminum layer. Some pertinent prior art in this field is summarized below.

THE PRIOR ART (1) DDR-120.474 (HEISIG et al.) discloses an installation for the precleaning by sputtering before plating under vacuum of a stainless strip. The precleaning unit can be integral with or separated from the plating unit itself. The precleaning unit comprises a plurality of magnetron elements arranged consecutively along the defilading strip (see the drawing). The strip is narrowly confined in the discharge region of the magnetrons by means of rolls (7) which prevent it from touching the pole-pieces of the magnet or the anode on the other side of the strip. The strip is grounded as well as the remainder of the apparatus; only the anode is insulated and held at positive voltage relative to the strip. Seventy % of the energy fed to the magnetrons is used up to heat the strip. The document does not specify how the sputter-cleaned strip is vacuum-plated afterwards.

(2) DDR-136.047 (STEINFELDE et al.) discloses a row of plasmatrons for the repeated etching of a strip moving continuously. The efficiency of the etching is sufficient to permit subsequent coating without the need to heat the strip to high temperatures. The plasmatron gas discharge devices comprise a hollow roll of non-ferromagnetic material containing a ring-gap magnet. The metal strip maintained at cathode potential travels via guide-rolls along a hollow anode located opposite said hollow roll. A gas under reduced pressure is fed into the discharge zone via a tube with calibrating valve.

(3) EP-A-270.144 (N. V. BEKAERT) discloses an apparatus for the continuous sputter-etching of elongated substrates such as wires, strips, cords, and the like, before coating. In this apparatus, the elongated substrate is guided through a thin anode cylindrical chamber flushed by a sputtering gas at pressures of $10^{-4}$ to $10^{-7}$ Torr. A voltage of 100–1000 V is applied between the substrate (which is at ground potential) and the anode, whereby a glow discharge is established and a plasma is formed around the substrate with a current of 50–200 mA. The substrate and the sputtering gas move in opposite directions within the tube which increases the etching efficiency. Alternatively, an AC potential can be applied to the electrodes for RF-sputtering.

(4) FR-A-2.578.176 (ELECTRICITE DE FRANCE) describes a device for etching flat substrates, e.g. continuous strips, by means of a plasma resulting from a corona discharge. This device can include a series of successive plasma generators each of which comprises a grounded plate for supporting the substrate to be etched (generally an insulating sheet or strip material) in registration with a slotted ridge-shaped anode supplied with a plasma generating gas. When energized, this arrangement produces a stream of plasma which strikes the strip to be etched at an angle near 90° or less. The plasma is generated at a potential from about 10 to 20 kV and a frequency below 100 kHz.

(5) EP-A-169.680 (VARIAN) discloses a planar magnetron etching device incorporating a movable magnetic source opposite the surface of the object to be sputter-etched. Lines of magnetic flux move over the surface to be etched thus creating a constantly changing magnetic field profile everywhere on the surface. If two surfaces must be etched simultaneously, a separate magnetic source moves in registration with the other surface. The magnetic source comprises radial magnets in a magnetically permeable ring encased in stainless steel. The source may be mounted on a shaft driven by vanes in a flow of coolant liquid to cause excentric rotation. If reactive ion etching is desired, a reactive gas may be admixed with the plasma generating gas.

(6) Japanese Patent Publication No. 60-052519 (TOYOTA JIDOSHA) discloses a method for the surface treatment of cast iron materials for increasing pit resistance. The method includes the steps of coating the surface of the iron with aluminum (by plasma spraying, hot dipping, vacuum deposition or the like) and remelting the Al surface layer by a high energy beam. This produces a wear-resistant surface layer on the iron material without the need of adding alloying elements to the casting.

(7) An article by S. Schiller et al. in 2nd International Conference on Metallurgical Coatings, 28.3 (1977), San Francisco, USA, details some of the conditions for the etch-precleaning of stainless strips before coating with metals. These authors used a ring-gap plasmatron discharge of 400–700 V under 0.6–6 Pa of argon. The current density was about 100 mA/cm$^2$ and the power consumed was about 1 kW per plasmatron for a 10 cm wide strip defilading at a rate of 0.05–0.1 m/sec.

DDR-132891 (HEISIG et al.) discloses a plasmatron sputtering apparatus in which a plurality of substrates are secured to the inside surface of a dome-like carrier with spherical curvature, this surface being in facing relation with a target to be sputtered and being rotated during sputtering so that each substrate will pass, in turn, in registration with the beam of sputtered material for coating. No preliminary etching of the substrates is contemplated in this disclosure.

U.S. Pat. No. 4,175,030 (R. B. LOVE et al.), discloses an apparatus for sputter-coating simultaneously two substrates in strip form which move in parallel on both sides of a central sputtering element placed in a symmetrically centered planar position of a longitudinal sputtering enclosure. The sputtering element comprises a plurality of magnets supported within a frame and target plates on opposite sides of the center plane. No independent etching station is contemplated in this apparatus.

GB-A-926,619 (CONTINENTAL CAN) discloses the dip-coating of steel strips with molten aluminium. In the disclosed method, the scale and other impurities adhering to the steel are removed prior to coating by heating in the presence of hydrogen or by contacting with a molten salt bath. No cleaning of the steel by plasmatron etching is contemplated in this document.

DE-C-665,540 (SIEMENS) discloses the melt coating of metal wires of Ni, Fe, Mo, W or Ta (p. 2 col. 2, lines 54–55) by running said wire from a dispensing spool (4) to a collecting spool (5) immersed in a molten metal. Between the dispensing and collecting spools, the wire crosses an arc- or glow-discharge etching device consisting of a tube 6 and an electrode 3 brought to high potential; the other electrode is constituted by the molten metal (of unspecified kind). So in this prior art method, the molten metal is electrically involved while it is electrically independent in the invention. Furthermore the technique of the reference applies to the plating of wires, not strips, and the take up spool 5 being immersed continuously in the molten metal, there is doubt about the utility of the system.

Other conventional hot dip plating techniques are disclosed, see for instance in U.S. Pat. No. 4,675,214 ARMCO and EP-A-176 109 (MISSHIN STEEL); in such techniques, the stainless strips are reduced with flue gases or hydrogen before plating. Other techniques involve, prior to coating, the continuous etching of a moving strip-like substrate, this being combined in a last step with a direct in-situ metal plating operation for which low pressure metal vaporization coating methods are recommended.

SUMMARY OF THE INVENTION

However, these methods are generally tedious and costly; in contrast, the method of the present invention is summarized by the following:

Method for the continuous plating of a stainless steel strip with an adherent, protective layer of aluminum, which comprises the steps of:

a) introducing the strip at an end of an elongated low pressure argon swept enclosure and continuously circulating it within said enclosure along a path very close to a series of magnetron devices and in registration therewith, so that the strip is subjected, as it travels along said path, to a series of low argon pressure plasmatron discharges from said magnetron devices and the surface of the strip becomes regularly and efficiently etched by said plasmatron discharges;

b) off-line passing the freshly etched strip into a bath of molten aluminum and withdrawing it afterwards, so that a layer of said aluminum deposits by dip-coating on the etched surface of the strip and solidifies upon withdrawal and cooling into a thin, homogeneous and strongly adherent aluminum film;

c) collecting the aluminum plated strip by rolling it over a take-up spool.

Thus the method proposes to directly combine magnetron plasma etching, in a first step, with dip-coating, and molten aluminum bath, in a second step.

Many advantages result from the application of the present method including very high etching efficiency even for hard to remove oxides like chromium, well adhering aluminum films, easy control of protective film thickness and relatively low production costs due to compactness of the apparatus for achieving the method, and high production rates. The apparatus is disclosed as follows:

Apparatus for continuously dip-plating with aluminum on both sides of a stainless steel sheet-iron strip comprising:

a) an elongated vacuum enclosure swept by argon under about $10^{-4}$–$10^{-2}$ mbar of pressure provided with gastight means for feeding and circulating unplated strip throughout the enclosure, b) a both of molten aluminum and means for continuously circulating the strip therein and removing it afterward, so that the strip is dipped into the molten aluminum and a layer thereof is coated on the strip surface and solidifies by cooling upon withdrawal from the bath;

c) a plurality of reciprocally acting plasma magnetron etching devices alternatively placed, in succession in the enclosure along the moving strip and on both sides thereof, each of said devices comprising i) a magnet element on one side of the strip and, in registration therewith, ii) a counter-electrode on the other side of the strip, and iii) means to apply a positive voltage thereto relative to the strip to generate a low pressure argon plasma discharge which will be concentrated by the magnetic field of the magnet element to at least one confinement zone between the strip and said counter-electrode, the whole arrangement being so that both sides of the displacing strip are progressively and controllably etched by the plasma in the confinement zones of the successive etching devices before the strip enters the molten aluminum bath, thus assuring optimalized cleaning of the strip and optimalized wetting and adhesion of the coating metal on the steel surface.

DETAILED DESCRIPTION OF THE INVENTION

Figures 1, 2:
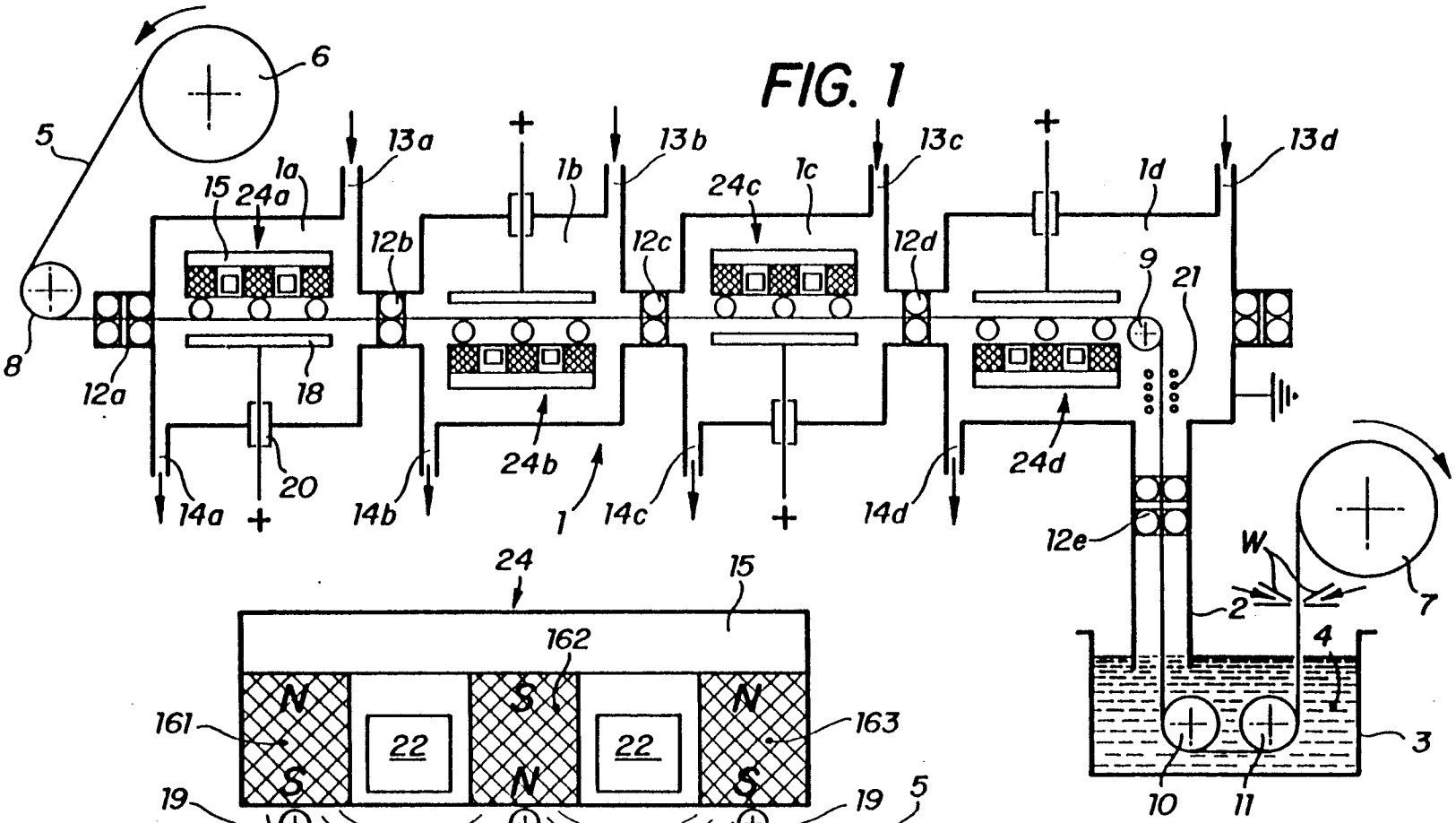
FIG. 1 is a schematic view of an installation for the combined plasma etching of a stainless steel strip and Al hot-dipping of said strip after etching.
FIG. 2 is an enlarged schematic view of an etching magnetron device used in the installation of FIG. 1.

The installation represented on FIG. 1 comprises an enclosure consisting of four successive tubular compartments 1*a*–1*d* connected to each other by reduced diameter apertures and terminated by a spout 2 which penetrates into a bath 3 of molten aluminum 4.

A continuous stainless strip 5 is circulated within the installation starting from a feed-spool 6 up to a take-up spool 7 at the end of the line. The strip is guided by main rollers 8, 9, 10 and 11, and by seal-roll chambers 12*a* to 12*e* which also provide gas pressure isolation between compartments and from the outside. Seal-roll chambers are detailed in document EP-A-176 109 incorporated by reference.

The components 1*a* to 1*d* of the present installation are provided with input ducts 13*a* to 13*d*, respectively, and output ducts 14*a* to 14*d*, respectively. The output ducts are used in connection with one or more suitable pumps to establish a reduced pressure within the enclosure. The input ducts are used to introduce a gas at low pressure to sustain the plasmatron discharges in the compartments; this gas is usually argon. In an embodiment of the present installation, the seal-roll chambers 12*b*, 12*c* and 12*d* can be omitted, whereby only one input duct, for instance 13*d*, and only one output duct, for instance 14*a*, are still necessary to maintain the full enclosure under the required low pressure of argon and all the other input and output ducts can be suppressed as well as the reduced diameter section between the compartments; in this case, the overall shape of the enclosure along its length remains approximately constant.

Each compartment of the present enclosure 1 contains a plasmatron device 24 (individual plasmatron are given the reference numbers 24*a* to 24*d*) which is represented on an enlarged scale in FIG. 2. A plasmatron device of the kind used in the present embodiment comprises a magnet frame 15 carrying three magnets, respectively 161, 162 and 163 arranged in order of alternating polarity, so that the magnetic field created by said magnets is closed in a confinement space between the magnets and an anode 18, as represented by reference 17 on the drawing. The magnets are placed very close to the path of the circulating strip 5 so that the strip will circulate within the confinement space 17 while being prevented from rubbing against the magnets by means of rolls 19 made of a non-magnetic material, for instance bronze or austenitic steel. The anode 18 is connected to a positive terminal of an electric generator (not shown) by a lead passing through an insulator 20 (for instance of steatite).

When the strip is at ground potential (as is the enclosure as shown in the drawing) and the cathode 18 is at a positive voltage of a few hundred volts, for argon pressures of a few microbars, a luminescent discharge is generated in the confinement zone 17, as shown by the darkened area in FIG. 2. Therefore the strip which passes through the luminescent discharge in zone 17 is etched by the impact of the gaseous ions formed in this region. Reference 22 designates cooling passages through which coolant fluids can be passed in case refrigeration is needed.

The several successive magnetron devices housed within successive compartments 1*a* to 1*d* are identical with that represented in FIG. 2, however they are arranged in successive alternate head-to-foot orientation, so that both sides of the strip can be etched as the strip 5 progresses along its path in the enclosure.

Under operation, the strip 5 moves along its path in the enclosure 1 and each portion thereof passes successively in the discharge zones 17 of each successive plasmatron device 24*a* to 24*d*. Of course, if desired, the number of compartments with respective plasmatron can be more than 4, for instance 6, 8 or more. After passing the last discharge zone, the etched strip is guided through seal-roll chamber 12*e* and spout 2 into the bath of molten aluminum 4, whereby it becomes coated with a film of aluminum. The coating weight (thickness) is controlled by means of a conventional wiping apparatus N or an equivalent, after which the aluminium solidifies by cooling. Then the plated strip is stored over take-up spool 7.

Under normal operation, the energy developped in the plasmatron discharge is sufficient to heat up the strip to the desired temperature before it enters the molten aluminum bath. If this heating effect is insufficient (for instance when operating under limited magnetron power output) a supplemental heating device 21 can be used to raise the temperature of the strip to the desired value. This heating device can be for instance a thermoelectric element or a HF induction-coil element.

Figure 3:
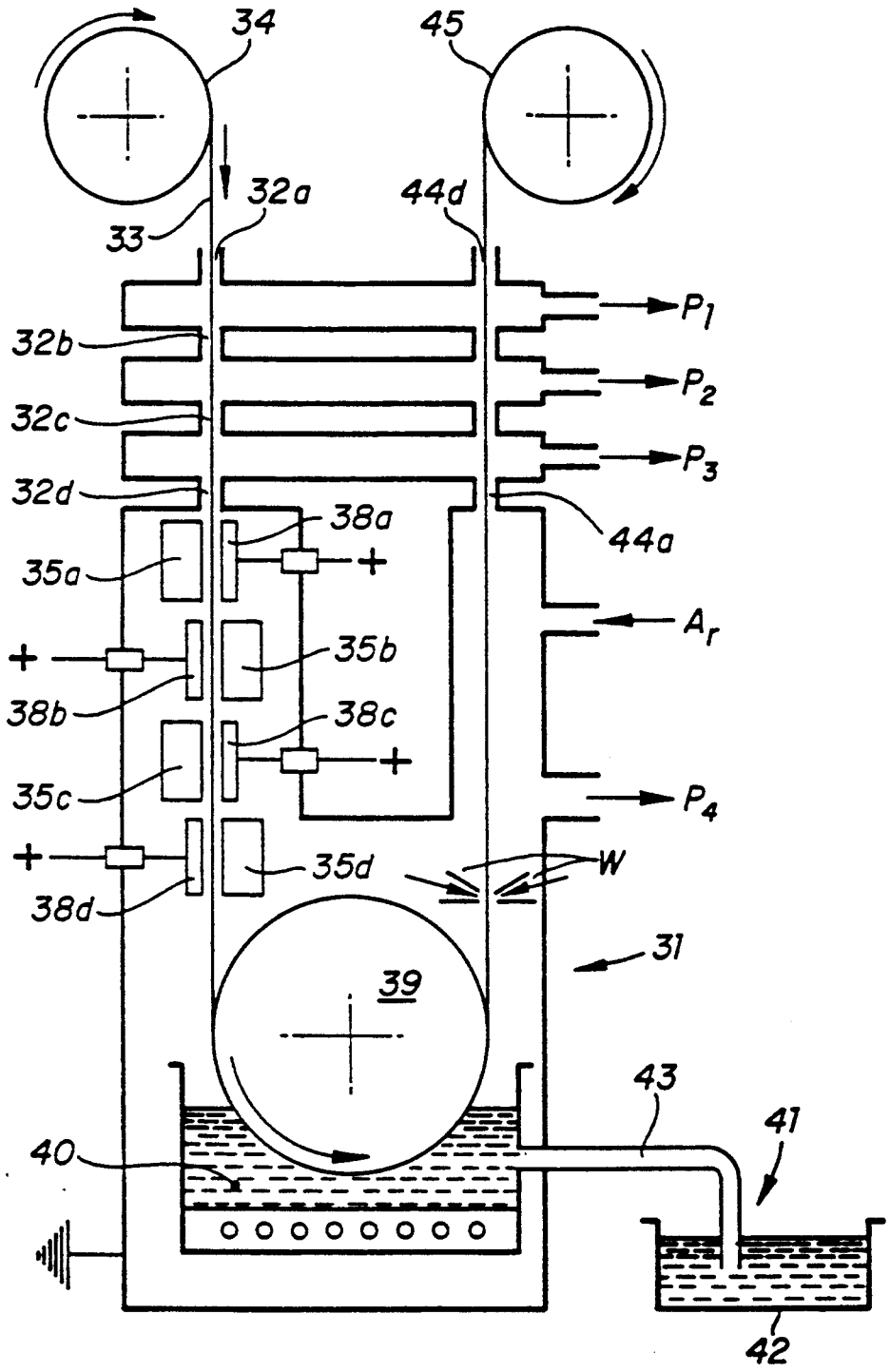
FIG. 3 is a schematic view of another embodiment for the combined plasma etching of a stainless steel strip and its subsequent off-line plating by hot-dipping into molten aluminum.

FIG. 3 represents schematically another apparatus for the continuous etching and subsequent immediate plating of a stainless strip.

This apparatus consists of a double-sided enclosure 31, made for instance of high grade steel, one side being for the entrance of unplated strip and the other side for the removal of the plated strip. The entrance side comprises a succession of reduced size openings 32*a* to 32*d* of very narrow diameter to provide a pressure tight passage to a strip 33 supplied by a spool 34 which circulates vertically in the enclosure 31. Normally, the clearance between the strip and the edges in the passages 32*a* to 32*d* should be in the order of a few tens of μm (e.g. 30–100 μm) to be sealingly effective.

Then, the entrance side of the enclosure comprises a series of magnetron devices 34*a* to 34*d* each of which corresponds to that illustrated in FIG. 2 and comprising a magnet unit 35*a* to 35*d* and an anode (38*a* to 38*d*). The magnet units and the corresponding anodes are in registration with the moving strip 33 exactly as disclosed in the previous embodiment so that the strip becomes etched on both sides as it progressively passes through the discharge zones generated between the strip surface (at cathode potential) and the respective anodes.

As the strip leaves the last magnetron element (35*d*, 38*d*) it passes over a turning roller 39 which is partly immersed in a molten aluminum bath 40, this bath being replenished as necessary with molten metal by syphoning means 41 represented schematically by a reservoir 42 of molten aluminum and a bent tube 43, the molten metal of reservoir 42 being raised to the level of the bath 40-by the atmospheric pressure working against the reduced pressure of argon within the enclosure 31; therefore the level of molten metal of bath 40 is maintained under control.

After being plated with Al by its passage in bath 40, the coating weight being conventionally controlled by wiping (see W in the drawing) the strip 5 leaves the enclosure through gas sealed passage means 44*a* to 44*d* which are of similar construction as the aforementioned passages 32*a* to 32*d*, and is stored over a take-up spool 45.

The enclosure 31 is provided with a series of opening ducts referenced $P_1$, $P_2$, $P_3$, $P_4$ and Ar. The P labelled ducts are for build up of progressively reduced pressure within the enclosure, i.e. they are connected to respective vacuum pumps (not represented), while duct labelled Ar is for the arrival of a plasma sustaining gas, usually argon.

The operation of this apparatus practically duplicates that of the previous embodiment. The strip supplied by the feed spool 34 penetrates into the enclosure through the successive gas tight openings 32*a* to 32*d*; it gets etched by passing through the discharge zones in the plasmatron devices 35*a*–38*a* to 35*d*–38*d*; then it is plated with aluminum by passing through bath 40 and, finally, it exits from the enclosure by passages 44*a* to 44*d* and is stored over take-up spool 45.

The following example illustrates the invention in detail.

EXAMPLE

An apparatus of the kind illustrated in FIG. 3 was used. The strip was a 0.5 mm thick and 1 m wide stainless strip; therefore the width of each magnetron (10 units) was in correspondence. The distance between the strip and the magnet elements was set to 8 mm (see rolls 19 in FIG. 1) and the discharge confinement zone between the strip and the anodes 38 (made of tantalum) was 25 mm thick 2×3 cm high (surface about 600 $cm^2$ for each magnetron). The magnets were made of samarium-cobalt alloy giving a magnetic field of intensity of 300 oersted in the working surface.

The pumps connected to outputs $P_1$ to $P_4$ gave, respectively, 10, $10^{-1}$, $10^{-3}$ and $10^{-5}$ mbar and the Argon input was adjusted to give about $3\text{-}5\times10^{-3}$ mbar argon pressure in the discharge areas. The molten aluminum was maintained at 640°-680° C. The strip was grounded through the enclosure and under 500-600 V DC, the discharge current was about 20-40 ma/$cm^2$ which means an energy consumption of 2-5 kw per magnetron. Occasionally, preheating of the strip before entering the bath of molten aluminum was applied.

With strip delivery rates of 20-60 m/min, homogenenous unpitted, well adherent Al plating of 3-100 μm thick were recorded.

We claim:

1. An apparatus for continuously dip coating both sides of a stainless steel strip with aluminum comprising:

a) an elongated vertically oriented vacuum enclosure having a bottom swept by argon under about $10^{-4}$-$10^{-2}$ mbar of pressure, b) a bath of molten aluminum located inside and at the bottom of said enclosure, said bath being connected via siphoning means to a supply of said molten metal submitted to atmospheric pressure so as to maintain a level of said bath at a constant;

c) means for feeding and circulating said strip through said enclosure and said bath, said feeding and circulating means including an input to said enclosure formed on a top end of said enclosure above said bath, a turning guide disposed in said bath for redirecting said strip being fed from said input of said enclosure, and an output from said enclosure formed above said bath on the top end of said enclosure, said output allowing the coating strip to pass therethrough;

d) gastight means for making the input and output of said feeding means airtight;

e) a plurality of reciprocally acting plasma magnetron etching and heating devices alternatively placed on both sides of said strip, said plurality of plasma magnetron etching and heating devices being disposed between said input and said bath, each of said devices comprising:

i) a magnet element on one side of the strip and, in registration therewith, ii) a counter-electrode on the other side of the strip, and iv) means for applying a positive voltage thereto relative to the strip so as to generate a low pressure argon plasma discharge that will be concentrated by a magnetic field of the magnet element to at least one confinement zone between the strip and said counter-electrode.

2. The apparatus of claim 1, in which said lowest pressure is about $3\text{-}5\times10^{-3}$ mbar of argon and the discharge is effected under about 300-1000 V and 10-1000 mA/$cm^2$ of the strip.

3. An apparatus for continuously dip coating both sides of a stainless steel strip with aluminum consisting of:

a) an enlongated vertically oriented vacuum enclosure having a bottom swept by argon under about $10^{-4}$-$10^{-2}$ mbar of pressure, b) a bath of molten aluminum located inside and at the bottom of said enclosure, said bath being connected via siphoning means to a supply of said molten metal submitted to atmospheric pressure so as to maintain a level of said bath at a constant;

c) means for feeding and circulating said strip through said enclosure and said bath, said feeding and circulating means including an input to said enclosure formed on a top end of said enclosure above said bath, a turning guide disposed in said bath for redirecting said strip being fed from said input of said enclosure, and an output from said enclosure formed above said bath on the top end of said enclosure, said output allowing the coating strip to pass therethrough;

d) gastight means for making the input and output of said feeding means airtight;

e) a plurality of reciprocally acting plasma magnetron etching and heating devices alternatively placed on both sides of said strip, said plurality of plasma magnetron etching and heating devices being disposed between said input and said bath, each of said devices comprising:

i) a magnet element on one side of the strip and, in registration therewith, ii) a counter-electrode on the other side of the strip, and iv) means for applying a positive voltage thereto relative to the strip so as to generate a low pressure argon plasma discharge that will be concentrated by a magnetic field of the magnet element to at least one confinement zone between the strip and said counter-electrode.

* * * * *